United States Patent [19]

Bunas et al.

[11] 4,390,389

[45] Jun. 28, 1983

[54] DATA SPLICE KIT

[75] Inventors: Norman L. Bunas; Gertrude I. Smith, both of Palo Alto, Calif.

[73] Assignee: Devoke Company, Santa Clara, Calif.

[21] Appl. No.: 338,624

[22] Filed: Jan. 11, 1982

[51] Int. Cl.[3] ..... B31F 5/06

[52] U.S. Cl. ..... 156/502; 156/304.3; 156/505

[58] Field of Search ..... 156/157, 159, 304.3, 156/502, 505; 144/253 B, 253 H; 83/438, 440, 441.1, 444, 448, 449

[56] References Cited

U.S. PATENT DOCUMENTS

| | | | |
|---|---|---|---|
| 536,651 | 4/1895 | Potter | 83/438 |
| 1,006,207 | 10/1911 | Hansen | 83/440 |
| 3,769,140 | 10/1973 | Sayer | 156/157 |
| 3,776,795 | 12/1973 | Stevenson | 156/157 |
| 4,252,597 | 2/1981 | Monroe | 156/505 |
| 4,289,556 | 9/1981 | Booth | 156/157 |

*Primary Examiner*—Michael G. Wityshyn
*Attorney, Agent, or Firm*—Robert G. Slick

[57] ABSTRACT

A splicing jig for data forms is provided having a flat plate with a plurality of upstanding fixed pins along one edge and a second movable plate having corresponding upstanding pins with means for moving the second plate with respect to the first, whereby forms of varying width can be accommodated.

1 Claim, 3 Drawing Figures

DATA SPLICE KIT

SUMMARY OF THE INVENTION

Data processing equipment frequently uses continuous paper forms which have perforations along each marginal edge. Normally the spacing of the marginal perforations is one-half inch but typical forms come in a wide variety of widths ranging from $4\frac{1}{4}$ inches to $14\frac{7}{8}$ inches.

It is frequently desired to splice two sheets of forms together so that one might utilize a portion of a carton of paper or possibly make forms which are longer than the standard carton for use with an unattended printer. By splicing two or more cartons of paper long, uninterrupted print runs can be made.

Since the paper form may come in various widths, it is normally necessary to provide a separate splicing jig for each width or to employ complex, expensive adjustable jigs.

In accordance with the present invention, a simple, inexpensive jig, which is positive in operation, is provided to enable one to splice a wide variety of widths of paper.

In a preferred embodiment of the present invention, a jig is shown having seventeen adjustment points whereby it will accommodate all of the most popular widths ranging from $4\frac{1}{2}$ inches to $14\frac{7}{8}$ inches. However, this versatility might not be required in all cases so that one might utilize the present invention to provide a jig having fewer or more adjustment points, or the adjustment points might be eliminated altogether so that nonstandard paper could be spliced.

DESCRIPTION OF THE PREFERRED EMBODIMENTS

Figure 1:
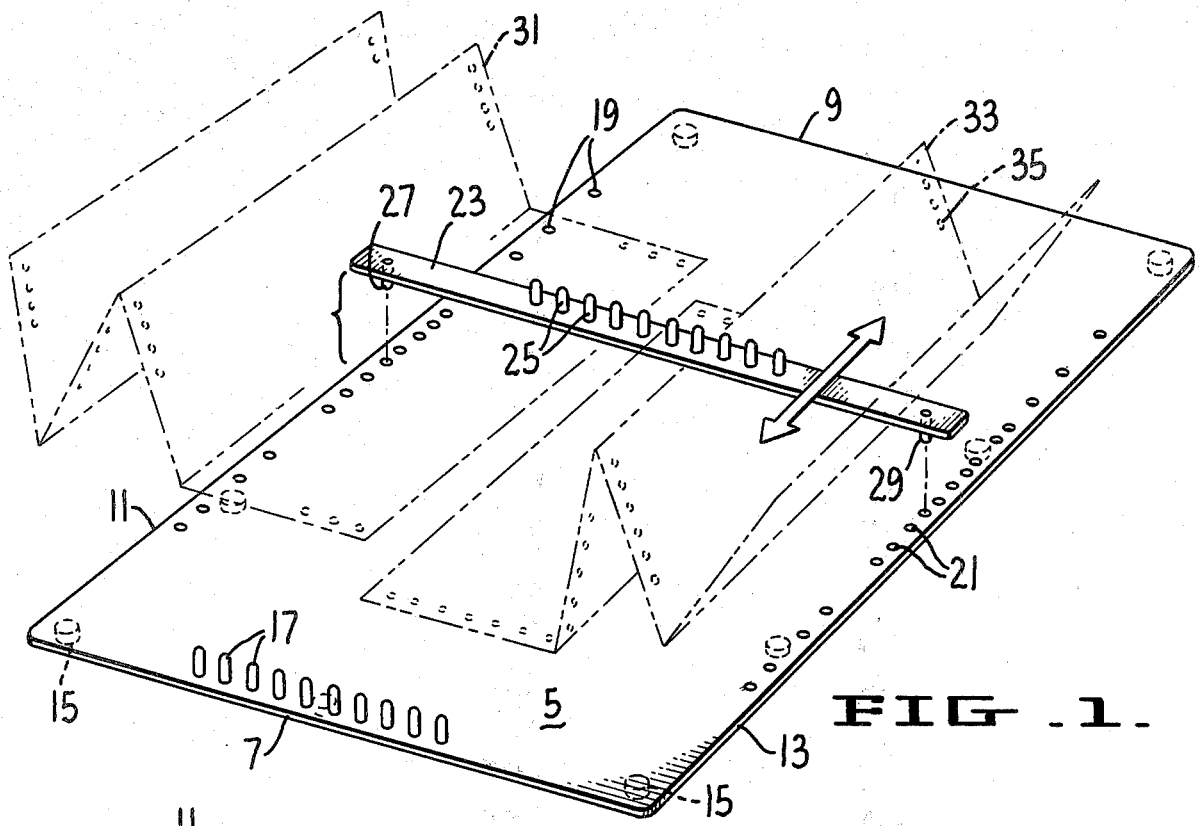
FIG. 1 is a perspective view of a device embodying the present invention.

Referring now to the drawings by reference characters, the jig of the present invention includes a first, fixed member 5, preferably in the form of a flat rectangle of metal or plastic having edges 7, 9, 11 and 13. Preferably, the member 5 is provided with rubber feet 15 to conveniently support it on a table or the like.

The member 5 has a plurality of pins 17 along the edge 7, the pins being in a straight line and being spaced by the distance of the perforations of the forms to be spliced. Normally this is one-half inch although, of course, the spacing would be slightly different for metric forms. In the preferred embodiment of the invention, along the edge 11 is a series of holes 19 and along the edge 13 is a series of holes 21. As can be seen from the drawing, the holes 19 and 21 correspond in number and placement. The spacing between the holes and the edge correspond to the widths of various standard forms measured from the pins 17.

A movable member 23 is provided and this has a plurality of upstanding pins 25 corresponding in number and placement to the pins 17. In the preferred embodiment, the member 23 also has two downwardly directed pins 27 and 29 which are adapted to fit into the holes 19 and 21 respectively.

Figure 2:
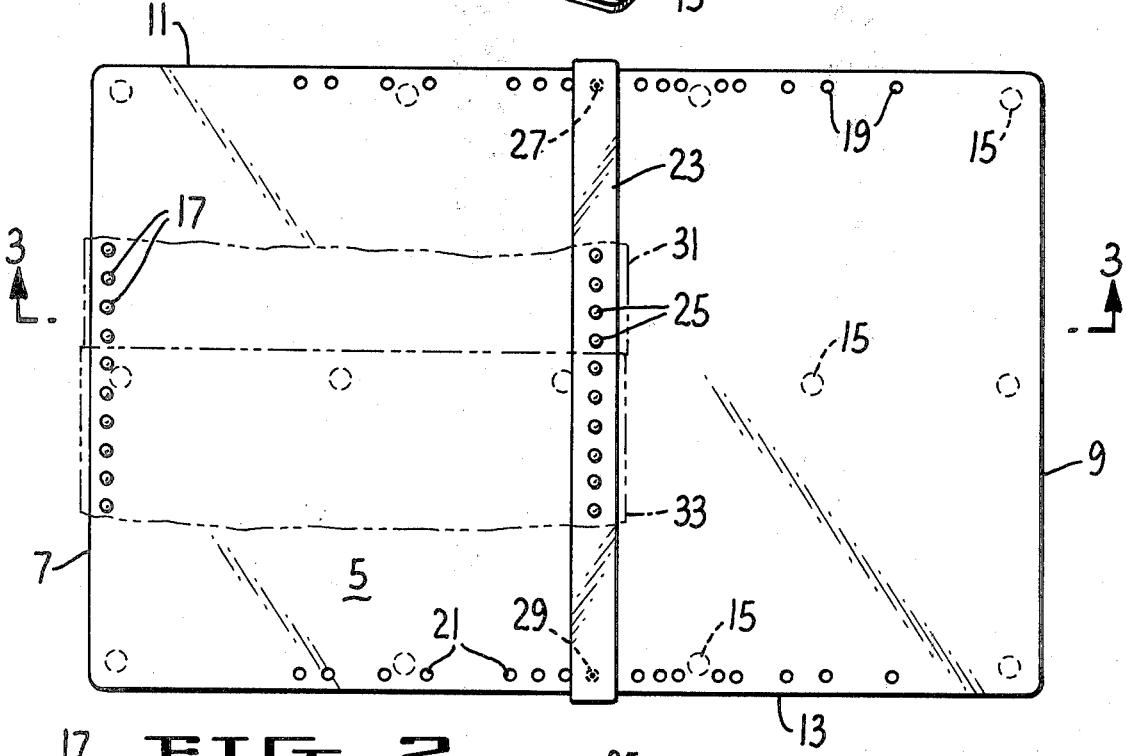
FIG. 2 is a plan view of the jig of the present invention.
Figure 3:
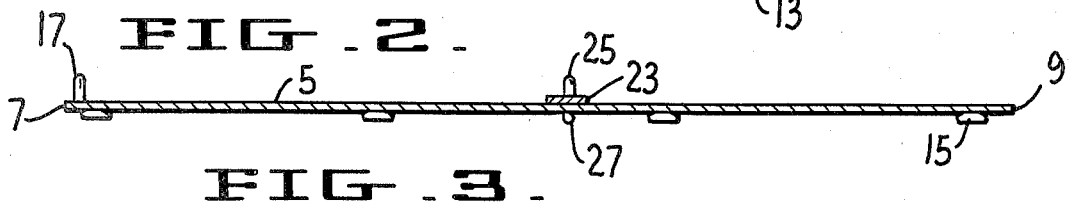
FIG. 3 is a section on the line 3—3 of FIG. 2.

In FIGS. 1 and 2, two fan-fold data forms are shown in phantom, namely, a first form 31 and a second form 33, it being the object of the jig to butt-splice the two forms together. Each form has a plurality of holes such as at 35 along each marginal edge, the spacing of the holes corresponding to the spacing of the pins 17 and, of course, the pins 25. To use the device, one merely places the member 23 over the flat plate 5 with the pins 17 and 25 displaced from each other by the displacement of the holes on the marginal edges of the forms 31 and 33. Now one places one of the forms 33 over a sufficient number of the pins 17 and 25 to secure accurate registration and then butts the form 31 up to form 33, again engaging a plurality of the pins 17 and 25, holding the forms in accurate alignment. One can now easily splice the two forms together utilizing any known means such as pressure sensitive tape or, particularly, perforated tape made especially for this purpose.

Although a specific embodiment of the invention has been illustrated, it will be obvious to those skilled in the art that many variations can be made without departing from the spirit of this invention. For instance, the number of upstanding pins could be increased or decreased and the number of positions to which the movable member can be adjusted could be changed. Other methods might be employed to hold the movable member in fixed or at least parallel relationship to the fixed member, but the pin arrangement shown is preferred because it is simple and highly effective. For instance, the terminal ends of the movable member could be bent down and under the fixed member to provide a sliding, parallel structure or the movable member might be allowed to "float".

The jig of the present invention will also splice multipart forms. That is, 2, 3, 4, 5, 6 < part forms, either interleaved with carbon or of the carbonless transfer type. The user tapes the top form, removes from the board, reverses so the bottom form is on top and then tapes that and so on.

It is preferred that the pins be spaced at the same intervals as the holes in the forms but this is not strictly necessary. For instance, the pins could be spaced one inch and engage every other hole.

We claim:

1. An adjustable splicing jig for continuous paper forms having evenly spaced perforations along each marginal edge wherein said forms may vary in width comprising in combination:

(a) a generally rectangular flat base having a plurality of upstanding pins aligned along one marginal edge of said base, the spacing of said pins being equal to the spacing of at least some of said perforations, (b) a plurality of complementary spaced holes at both the top and bottom edges of said base, (c) a movable member having a plurality of upstanding pins corresponding to the pins on the marginal edge of said base and having a downwardly directed pin at each end thereof to engage opposed holes at the top and bottom edges of the base whereby the upstanding pins of said movable member are maintained parallel to the upstanding pins on said base, (d) whereby said movable member can be moved across said base and held by said downwardly directed pins in selected opposed holes to accommodate forms of various widths.

* * * * *